US007992223B2

(12) United States Patent
Manzo

(10) Patent No.: US 7,992,223 B2
(45) Date of Patent: Aug. 9, 2011

(54) PROTECTIVE ATHLETIC BAND

(75) Inventor: Joseph S. Manzo, Lansdale, PA (US)

(73) Assignee: Brain-Pad Incorporated, Conshohocken, PA (US)

( * ) Notice: Subject to any disclaimer, the term of this patent is extended or adjusted under 35 U.S.C. 154(b) by 1191 days.

(21) Appl. No.: 11/419,560

(22) Filed: May 22, 2006

(65) Prior Publication Data

US 2007/0011796 A1 Jan. 18, 2007

Related U.S. Application Data

(60) Provisional application No. 60/700,128, filed on Jul. 18, 2005.

(51) Int. Cl.
*A42B 1/04* (2006.01)

(52) U.S. Cl. ..... 2/171

(58) Field of Classification Search ..... 2/171, 174, 2/67, 69, 84, 171.1, 172, 181.4, 202, 204, 2/205, 207, 918
See application file for complete search history.

(56) References Cited

U.S. PATENT DOCUMENTS

| | | | | |
|---|---|---|---|---|
| 4,462,116 | A | 7/1984 | Sanzone et al. | |
| 4,829,604 | A * | 5/1989 | Allen et al. | 2/170 |
| 4,910,804 | A | 3/1990 | Lidgren | |
| 4,911,169 | A * | 3/1990 | Ferrari | 600/384 |
| 5,903,921 | A * | 5/1999 | Dow | 2/12 |
| 5,946,734 | A | 9/1999 | Vogan | |
| 6,000,062 | A | 12/1999 | Trakh | |
| 6,266,826 | B1 | 7/2001 | Alfano | |
| 6,625,820 | B1 | 9/2003 | Lampe | |
| 6,675,395 | B1 | 1/2004 | Abraham | |
| 6,702,772 | B1 | 3/2004 | Colditz | |
| 6,867,346 | B1 * | 3/2005 | Dopps et al. | 604/378 |
| 7,159,620 | B2 * | 1/2007 | Kissell | 138/149 |
| 2002/0189004 | A1 | 12/2002 | Aaron | |
| 2003/0041365 | A1 * | 3/2003 | Sanchez | 2/181.6 |
| 2003/0221241 | A1 | 12/2003 | Rivera et al. | |
| 2005/0125870 | A1 | 6/2005 | Spies | |
| 2006/0064798 | A1 | 3/2006 | Abraham | |

FOREIGN PATENT DOCUMENTS

| | | |
|---|---|---|
| GB | 2228181 | 8/1990 |
| WO | 86/00197 | 1/1986 |

* cited by examiner

*Primary Examiner* — Tejash Patel
(74) *Attorney, Agent, or Firm* — John F. Letchford; Archer & Greiner, P.C.

(57) ABSTRACT

A thin athletic band which is economical to manufacture yet provides considerable impact protection coupled with effective perspiration removal.

8 Claims, 1 Drawing Sheet

PROTECTIVE ATHLETIC BAND

CROSS REFERENCE TO RELATED APPLICATION

The present application claims the benefit of U.S. Provisional Patent Application No. 60/700,128, filed Jul. 18, 2005, which is incorporated herein by reference in its entirety.

FIELD OF THE INVENTION

The present invention relates in general to athletic equipment and in particular to protective athletic bands that can be worn about various areas of the human body.

BACKGROUND OF THE INVENTION

Many commercially available athletic bands are dedicated to perspiration absorption. A typical example is an elastic terry cloth band commonly known as a "sweatband" that is may be worn around the user's head or wrist. While well suited to absorbing the wearer's perspiration, sweatbands offer little meaningful protection from impacts arising from speeding balls (or other moving sporting equipment), or contact with other players and playing surfaces.

Other athletic gear are primarily protective in nature and are designed to absorb impacts. These devices are typically much more bulky and complex in construction than conventional sweatbands and are not adapted to provide effective perspiration absorption. An example of such protective gear may be found in U.S. Pat. No. 6,625,820.

Some athletic bands are constructed as a layer of impact-absorbing material wholly or partially contained within a layer of cloth. Examples of such bands may be found in U.S. Pat. Nos. 4,910,804; 5,946,734; 6,000,062; 6,266,826 and 6,675,395, as well as in Published U.S. Patent Application No. 2002/0189004. Of these, however, only U.S. Pat. No. 5,946,734 addresses the advantage of providing "breathable" impact-absorbing cellular material for the wearer's comfort. However, in the sole embodiment thereof which mentions this feature, the "breathable" open-cell foam is a bulky ⅝ to 1 inch in thickness which renders the band thick and bulky in appearance.

An advantage exists, therefore, a thin athletic band which is economical to manufacture yet provides considerable impact protection coupled with effective perspiration removal.

SUMMARY OF THE INVENTION

The present invention is a protective athletic band including a layer of breathable, moisture wicking material and a layer of perforated, impact-absorbent elastomeric material of less than about 3 mm in thickness. The band may be continuous or a strip having first and second detachably connectable ends. The resultant product is a thin athletic band which is economical to manufacture yet provides considerable impact protection coupled with effective perspiration removal.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
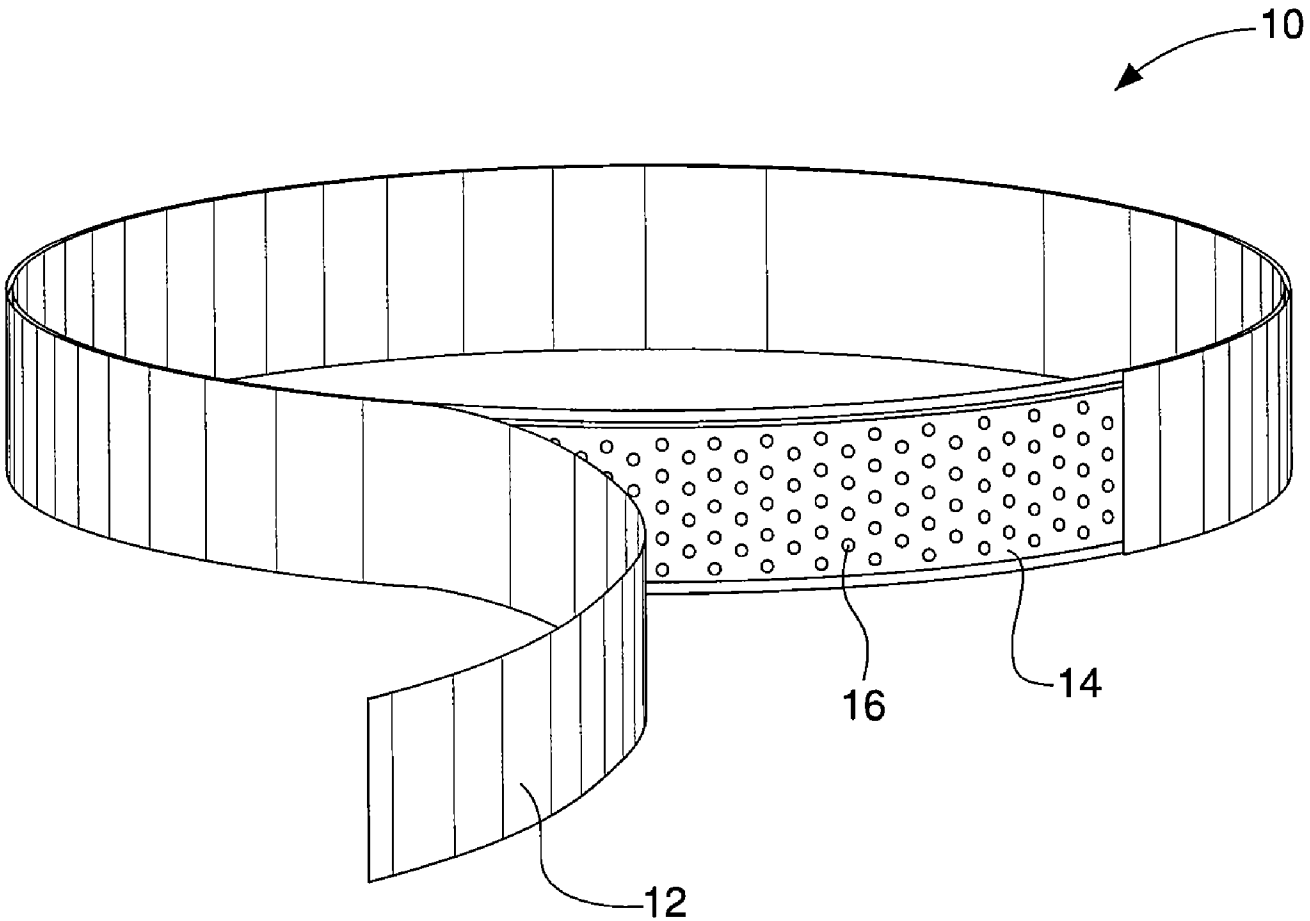
FIG. 1 is a perspective, partially disassembled view of a protective athletic band according to the present invention.

FIG. 1 reveals a preferred construction of a protective athletic band according the present invention. The athletic band, identified generally by reference numeral 10, comprises a layer of breathable, moisture wicking material 12 and a layer of impact-absorbent material 14. Although athletic band 10 is preferably constructed as an endless loop it may also be formed as a strip having first and second ends that are detachably connectable to one another such as by buttons, snaps, hook and loop type fasteners, or the like (not shown).

Moisture wicking layer 12 may be any suitable porous natural, synthetic or blended fabric such as, for example, elastic terry cloth or the like of the type commonly used in conventional sweatbands. According to a preferred embodiment, the moisture wicking layer preferably encloses or envelops the layer 14 of impact-absorbent material.

The impact-absorbent layer 14 is desirably a very thin, elastic, and breathable material. Layer 14 is preferably less than bout 3 mm in thickness so as to provide the band 10 with a very thin profile comparable to conventional sweatbands. According to the invention, layer 14 is a noncellular elastomeric material such as natural or artificial rubber, neoprene, Calprene®, or the like, provided with a plurality of perforations 16. A suitable material is a perforated, approximately 1.5 mm thick layer of noncellular Calprene® H-6170. The inventor has observed that such material effectively passes moisture from the wearer while at the same time providing more than a 50% reduction in impact force sensed by a wearer as compared to conventional fabric sweatband material alone. It will be appreciated that greater thicknesses, up to about 3 mm, will produce even greater impact absorption without noticeably compromising the thin profile of athletic band 10.

Layers 12 and 14 may be joined by any suitable means or method. In preferred embodiment, they are sewn together by conventional sewing equipment. The resultant band is thin and breathable and may be worn about any area of a user's body that is, depending on a particular sport, frequently subject to athletic impact such as the head, wrist, elbow and knee.

Although the invention has been described in detail for the purpose of illustration, it is to be understood that such detail is solely for that purpose and that variations can be made therein by those skilled in the art without departing from the spirit and scope of the invention as claimed herein.

What is claimed is:

1. An annular protective athletic band comprising:

a layer of breathable, moisture wicking terry cloth material; and a layer of perforated, noncellular elastomeric material of less than about 3 mm in thickness and capable of providing more than a 50% reduction in impact force sensed by a wearer as compared to said layer of terry cloth material alone.

2. The protective athletic band of claim 1 wherein said band is an endless loop.

3. The protective athletic band of claim 1 wherein said band is a strip having first and second detachably connectable ends.

4. The protective athletic band of claim 1 wherein said layer of perforated, noncellular elastomeric material is a perforated approximately 1.5 mm thick layer of Calprene® H-6170.

5. The protective athletic band of claim 1 wherein said layer of breathable, moisture wicking terry cloth material substantially encloses said layer of perforated, noncellular elastomeric material.

6. An annular A protective athletic band comprising:

a layer of breathable, moisture wicking terry cloth material; and a layer of noncellular elastomeric material of less than about 3 mm in thickness and capable of providing more than a 50% reduction in impact force sensed by a wearer as compared to said layer of terry cloth material alone.

7. An annular protective athletic band comprising:

a layer of breathable, moisture wicking terry cloth material; and a layer of perforated elastomeric material of less than about 3 mm in thickness and capable of providing more than a 50% reduction in impact force sensed by a wearer as compared to said layer of terry cloth material alone.

8. An annular protective athletic band comprising:

a layer of breathable, moisture wicking terry cloth material; and a layer of elastomeric material of less than about 3 mm in thickness and capable of providing more than a 50% reduction in impact force sensed by a wearer as compared to said layer of terry cloth material alone.

* * * * *

UNITED STATES PATENT AND TRADEMARK OFFICE

CERTIFICATE OF CORRECTION

PATENT NO. : 7,992,223 B2
APPLICATION NO. : 11/419560
DATED : August 9, 2011
INVENTOR(S) : Joseph S. Manzo It is certified that error appears in the above-identified patent and that said Letters Patent is hereby corrected as shown below:

At claim 6, column 3, line 5, after “annular” delete “A”.

Signed and Sealed this
Fourth Day of October, 2011

David J. Kappos

David J. Kappos
*Director of the United States Patent and Trademark Office*